United States Patent [19]

Behrens

[11] Patent Number: 4,589,499

[45] Date of Patent: May 20, 1986

[54] HORIZONTAL DRILLING APPARATUS

[76] Inventor: Robert N. Behrens, 4802 W. Laurel La., Glendale, Ariz. 85304

[21] Appl. No.: 636,132

[22] Filed: Jul. 30, 1984

[51] Int. Cl.[4] ..... E21B 7/02

[52] U.S. Cl. ..... 173/22; 173/35; 173/52; 280/638; 175/202

[58] Field of Search ..... 173/22, 23, 28, 35, 173/42, 52; 280/638; 408/79; 175/202, 203

[56] References Cited

U.S. PATENT DOCUMENTS

| | | | |
|---|---|---|---|
| 1,713,471 | 5/1929 | Gartin | 173/22 X |
| 2,168,905 | 8/1939 | Lear | 173/22 X |
| 2,520,390 | 8/1950 | Fencht | 173/42 X |
| 3,244,240 | 4/1966 | Ragnarsson | 173/52 X |
| 3,550,294 | 12/1970 | Fewell | 280/638 X |
| 4,222,687 | 9/1980 | Williams | 173/35 X |
| 4,350,222 | 9/1982 | Lutteke | 280/638 X |

*Primary Examiner*—E. R. Kazenske
*Assistant Examiner*—Willmon Fridie, Jr.
*Attorney, Agent, or Firm*—H. Gordon Shields

[57] ABSTRACT

Apparatus for drilling horizontal holes includes a frame for holding a drill, and the frame is supported by a single wheel adjacent to the drill and dual wheels at the opposite end of the frame from the drill. A cable system is utilized for moving the drill inwardly toward the work and outwardly away from the work by a single operator. A single operator can also move the frame as required at the work site. Multiple drills may also be secured to the frame, so that a plurality of holes may be drilled substantially simultaneously.

15 Claims, 13 Drawing Figures

HORIZONTAL DRILLING APPARATUS

BACKGROUND OF THE INVENTION

1. Field of the Invention

This invention relates to drill apparatus and, more particularly, to apparatus for drilling holes in the horizontal plane.

2. Description of the Prior Art

For drilling horizontally into concrete, generally two workers are required to hold and move a drill. Obviously, when manually operating a drill, successive holes will not generally be aligned parallel to each other and will not be substantially horizontally extending. Rather, because the efforts and skills of individuals change during the course of a day, and from day to day, the holes will generally be tilted slightly from the horizontal and may be at a slight angle one way or another from a desired or preferred orientation. Moreover, the use of two workers for operating a single drill is generally not cost effective as compared to using only one worker for a single drill. Moreover, the fatigue factor in manually operating a drill decreases the productivity of workers as compared to the productivity of utilizing a worker to operate a drill by remote control, as it were, which minimizes the fatigue factor.

For enlarging bridges, enlarging runways, etc., horizontal holes need to be bored into the concrete, and steel dowel pins are inserted into the holes for providing the necessary reinforcing steel bar or rebar framing for the new additions. This requires the extensive drilling of horizontal holes spaced regularly over the length of the project. As indicated in the preceding paragraph, this work has heretofore been accomplished by two men working together as a team, but with only a single drill.

Prior art drilling apparatus has been designed primarily for mining purposes and for drilling in rails for connecting adjacent lengths of rail. Such apparatus are exemplified by a number of patents, as discussed below.

U.S. Pat. No. 900,109 discloses a rail drilling machine which includes two drills. The apparatus is designed to run on wheels on the rails. The two drills are disposed below the wheels which support the framework holding the drills.

U.S. Pat. No. 1,180,554 discloses another type of rail drill apparatus which includes both rail wheels and road wheels. A single drill is supported by the apparatus.

U.S. Pat. No. 1,215,978 discloses another type of rail drill apparatus in which the drill system is movable vertically as well as horizontally.

U.S. Pat. No. 1,246,144 discloses another type of rail drill apparatus which utilizes only a pair of wheels spaced apart by an axle. A pair of drills is supported on a framework extending outwardly from the axle.

U.S. Pat. No. 1,380,991 discloses another type of rail drilling apparatus which utilizes a pair of drills extending in opposite directions. The drills are tied together through a gear system to a single source of power. The source of power is an engine supported on the same framework as used to hold the drills.

U.S. Pat. No. 416,600 discloses yet another type of rail drill apparatus utilizing a three-wheeled system. The drill is disposed between a pair of wheels at one side of the apparatus, while the opposite side of the apparatus includes only a single wheel. Power for the drill comes through a chain drive which is in turn connected through a gear system to an engine.

U.S. Pat. No. 1,844,873 discloses a horizontal rock drilling apparatus using a hydraulic ram and a cable system. The hydraulic ram is used to operate the rock drill, and the cable system is used to move the hydraulic ram. This apparatus is used for a hammer type drill, as opposed to a rotary drill. Rotary drills are disclosed in the above-discussed rail drill systems.

U.S. Pat. No. 2,143,105 discloses another type of feeding mechanism for rock drills. A chain drive system is used for moving the drill apparatus horizontally.

U.S. Pat. No. 2,152,150 discloses another type of chain and sprocket drive system for a drill. In this patent, the drilling apparatus is vertically oriented, as opposed to horizontally oriented.

U.S. Pat. No. 2,168,905 discloses a wheeled frame system for a horizontal drill in which the drill is moved relative to the wheeled frame. The frame includes two wheels on the drill portion of the frame, and a single wheel at the opposite end. The wheels are pivotally adjustable so that the frame may move in the direction of the drill or perpendicular to the direction of the drill.

U.S. Pat. No. 2,616,677 discloses a horizontally oriented auger type drill designed for mining purposes. The apparatus includes a tractor type crawler system for moving the drill apparatus transversely or perpendicularly to the direction of drilling.

U.S. Pat. No. 2,665,117 discloses another type of horizontally disposed auger drill system utilizing a wheeled carriage for moving the apparatus to the drill site. The apparatus then is supported on four legs during the drilling operation. The supporting legs are retracted in order to move the apparatus to a new drilling location. The wheels are aligned in the direction of drilling, and the apparatus accordingly does not move transversely to the direction of drilling, as for drilling successive parallel, or aligned holes.

U.S. Pat. No. 2,365,176 discloses another type of wheeled drill apparatus. The wheels allow the drill to be moved along the direction of travel of the drill.

U.S. Pat. No. 2,668,690 discloses a horizontal drilling system, designed for rock drilling, with the drill disposed beneath a supporting bar. The apparatus of the '690 patent is not on a wheeled structure, but rather is designed to be fixed in place, as in a mine, for drilling purposes.

U S. Pat. No. 2,745,637 discloses another type of mobile drilling system which utilizes both wheels and tractor treads. A drilling head is movable relative to the framework so that drilling may be accomplished at any desired angle with respect to the frame. This apparatus is designed for underground work, as in mines or tunnels.

U.S. Pat. No. 4,417,628 discloses a horizontal drilling system which is secured to a bucket of a backhoe. The drill is positioned by movement of the backhoe bucket.

It will be noted that none of the above discussed patents discloses apparatus designed for drilling horizontally into concrete or for movement in a generally horizontal direction for drilling holes spaced apart at regular intervals, as for purposes of inserting dowel pins into holes in concrete. Rather, the prior art apparatus discussed above are all designed for the specific purpose of mining or drilling into rock or earth, or else drilling into steel rails. It will also be noted that all of the patents, with the exception of the '628 patent, have long expired. Since the apparatus disclosed in each of the patents is designed for purposes other than that of the apparatus of the present invention, they are subject to the deficiencies which would be expected when apparatus designed for a completely different purpose is attempted to be adapted to a new, different application. For applications of horizontal concrete drilling, the specific prior art is the manual operation of the drills, as discussed above. In the apparatus of the present invention, the mechanization of the drilling is accomplished whereby a single operation may remotely operate a drill to provide consistent spacing and parallel orientation of successive horizontal holes in concrete.

SUMMARY OF THE INVENTION

The apparatus described and claimed herein includes a frame for supporting a drill, with the frame supported by a single wheel adjacent to the drill and by dual wheels remote from the drill, and for moving the apparatus transversely or perpendicularly with respect to the direction of drilling. The frame is expandable through telescoping frame members, and the frame may be moved vertically with respect to the wheels for moving the drill vertically, upwardly and downwardly. Movement of the drill towards and away from its work is accomplished through a winch and cable system. A plurality of drills may be secured to the framework. Horizontal movement of the apparatus and movement of the drill may be accomplished by a single operator.

Among the objects of the present invention are the following:

To provide new and useful horizontal drill apparatus;

To provide new and useful horizontal drill apparatus utilizing a wheeled frame;

To provide new and useful drill apparatus for drilling horizontally into concrete;

To provide new and useful apparatus for drilling a plurality of horizontal holes substantially simultaneously;

To provide new and useful drill apparatus operable by a single operator; and

To provide new and useful drill apparatus having a single wheel at one end of the frame and a pair of wheels at the opposite end of the frame for moving the frame and a drill secured thereto.

DESCRIPTION OF THE PREFERRED EMBODIMENT

Figure 1:
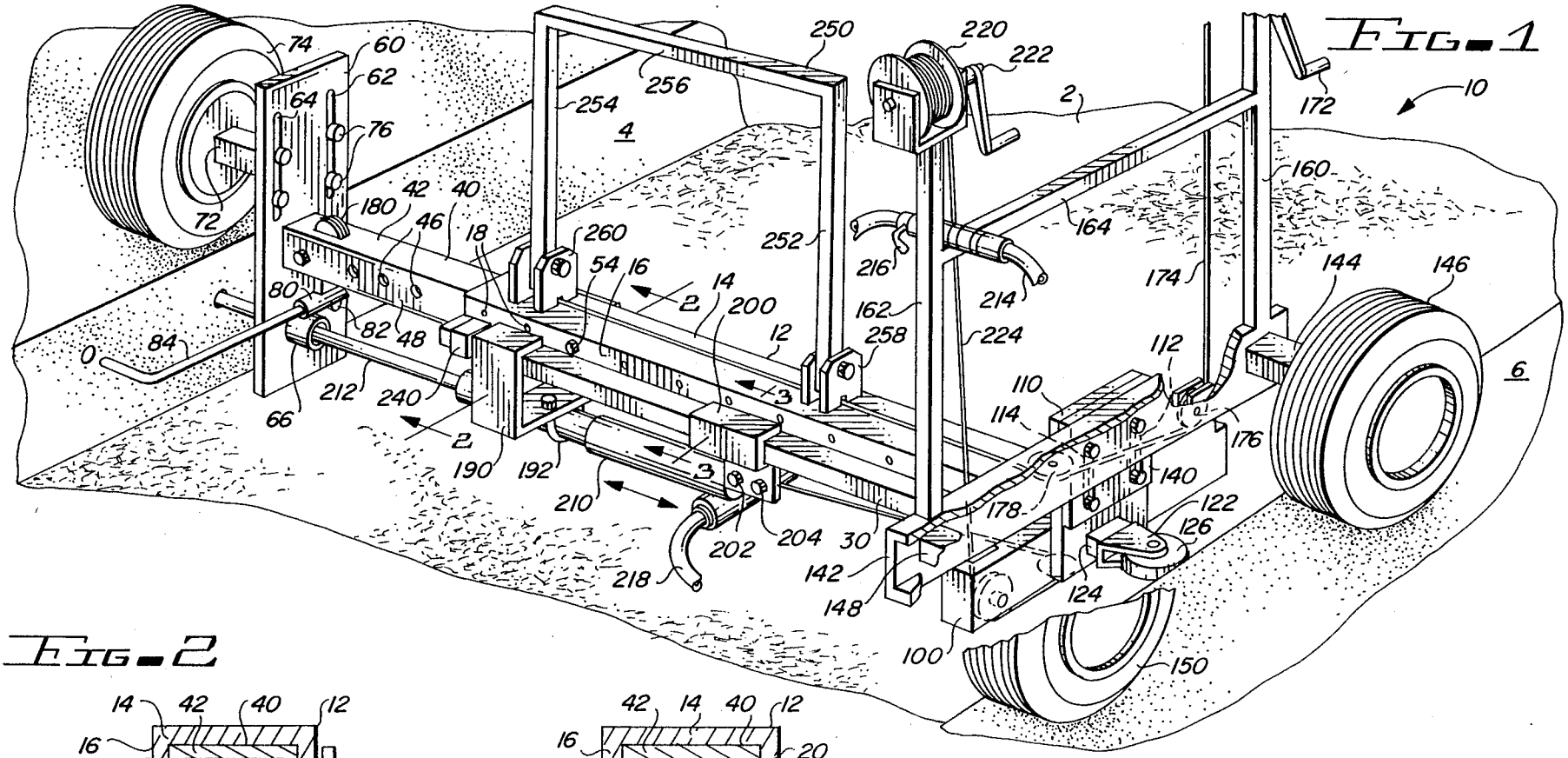
FIG. 1 is a perspective view of the apparatus of the present invention.
Figure 2:
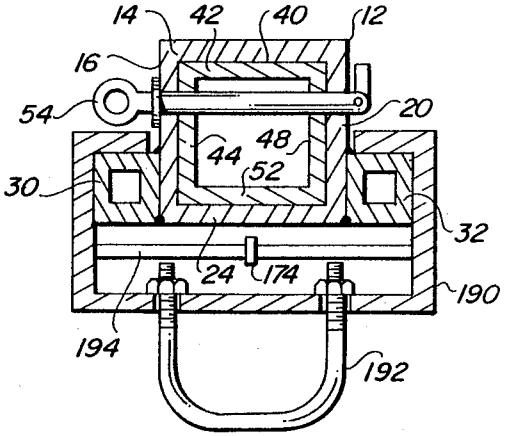
FIG. 2 is a view in partial section taken generally along line 2—2 of FIG. 1.
Figure 3:
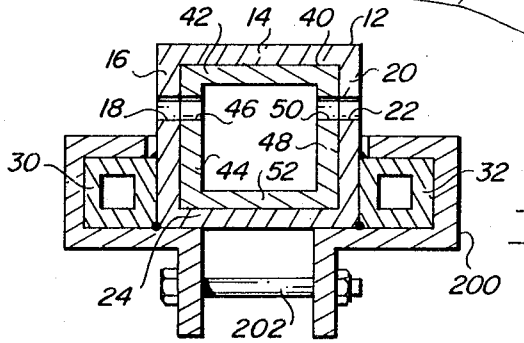
FIG. 3 is a view in partial section taken generally along line 3—3 of FIG. 1.
Figure 4:
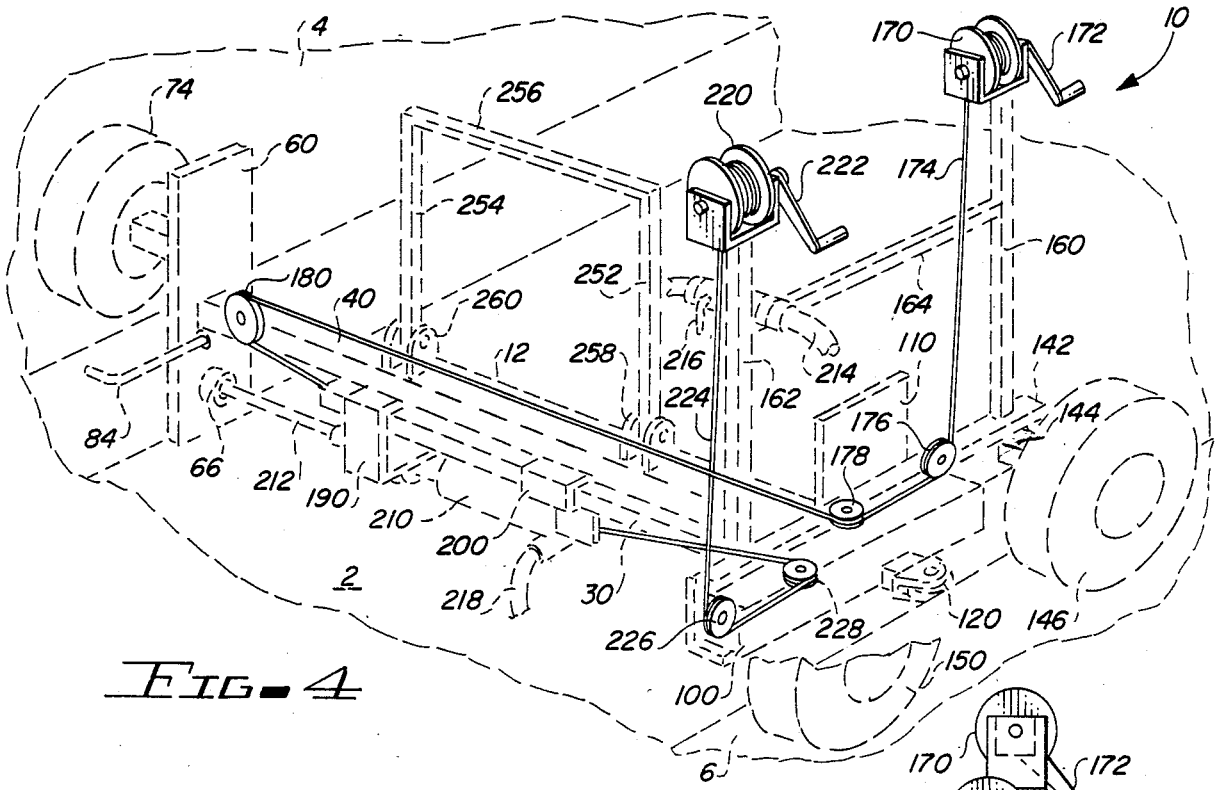
FIG. 4 is a perspective view, with portions of the apparatus in phantom, illustrating part of the apparatus of the present invention.
Figure 5:
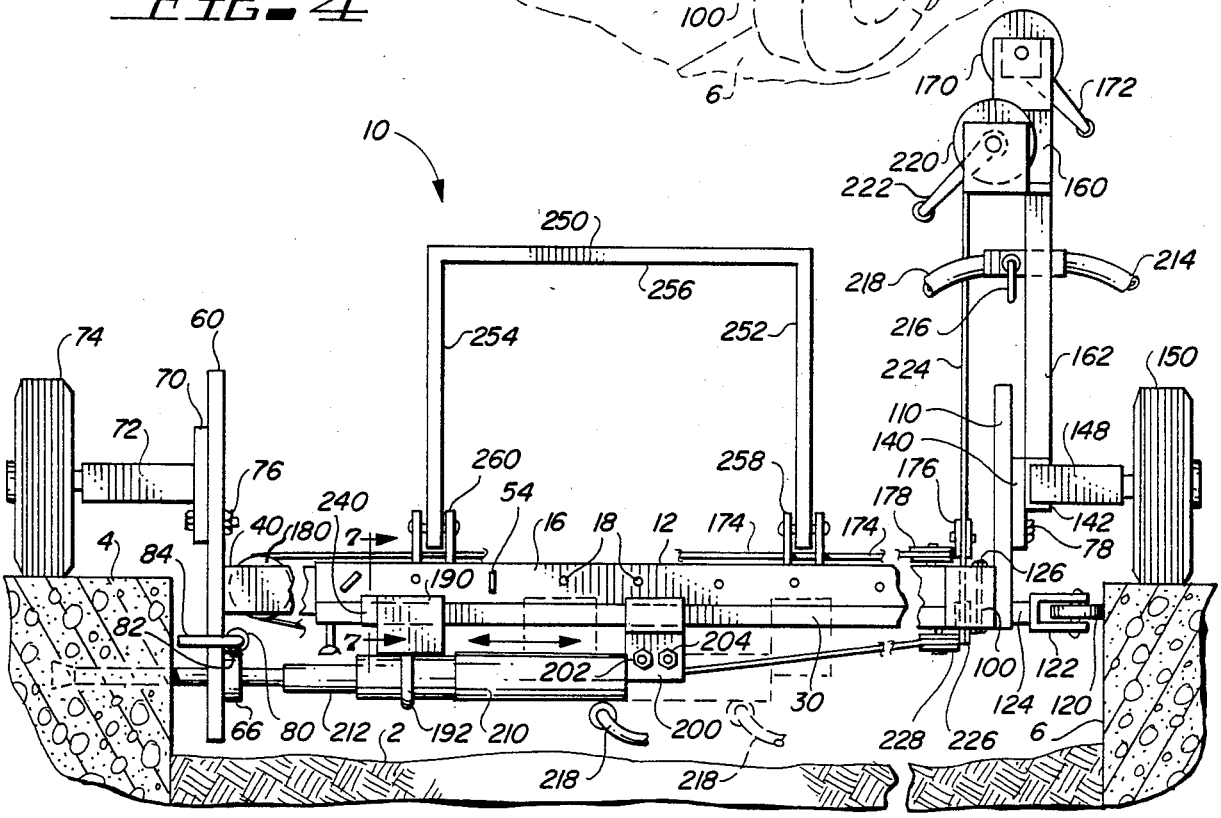
FIG. 5 is a side view of the apparatus of the present invention in its use environment.
Figures 6, 8:
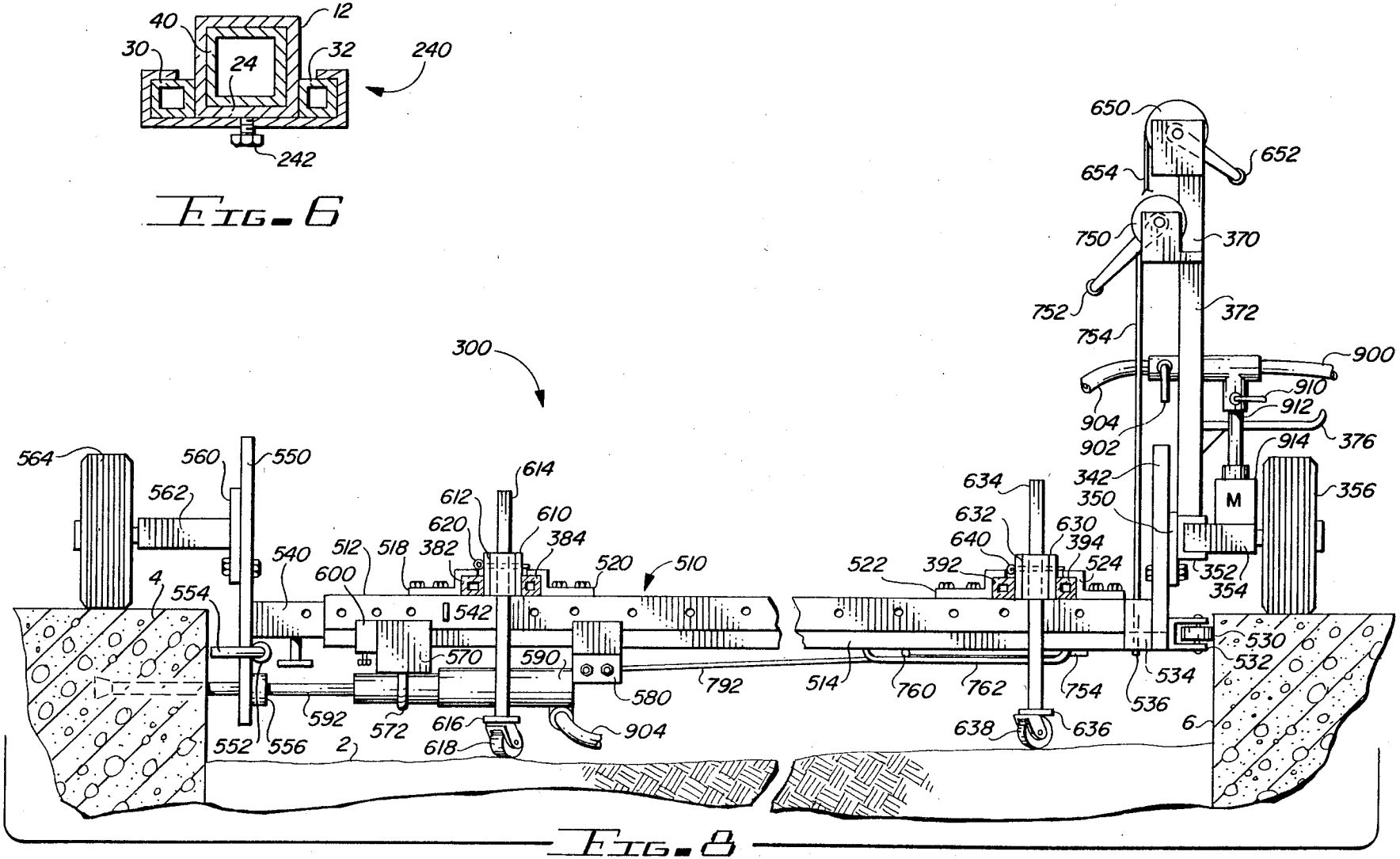
FIG. 6 is a view in partial section taken generally along line 6—6 of FIG. 5.
FIG. 8 is a side view of the apparatus of FIG. 6.

FIG. 1 is a perspective view of horizontal drilling apparatus 10 shown in its use environment. FIG. 2 is a view in partial section of a portion of the drill apparatus 10 of FIG. 1, taken generally along line 2—2 of FIG. 1. FIG. 3 is a view in partial section of another portion of the drill apparatus 10 of FIG. 1, taken generally along line 3—3 of FIG. 1. FIG. 4 is a perspective view of the drill apparatus 10, illustrating the operation of a portion of the apparatus. FIG. 5 is a side view of the drill apparatus 10. FIG. 6 is a view in partial section taken generally along line 6—6 of FIG. 5. For the following discussion, reference will primarily be made to FIGS. 1, 2, 3, 4, 5, and 6.

The horizontal drill apparatus 10 comprises a movable frame for holding a drill in a horizontal position for drilling holes into concrete. In FIGS. 1, 4, and 5, there is shown a trench 2 between a pair of concrete structures 4 and 6. The drill apparatus 10 is movable on the top of the concrete structures 4 and 6 for drilling holes horizontally into the side of the concrete structure 4. By way of an illustrative example, the concrete structures 4 and 6 may be a portion of a concrete runway, with the trench 2 disposed therebetween, as for purposes of laying pipe or cable in the trench. For sealing the trench 2, again with concrete, horizontal holes must be bored into the sides of the concrete structures 4 and 6. In turn, steel reinforcing dowel pins will be inserted into the horizontal holes and grouted to provide reinforcement for the new concrete portion. The drill apparatus 10 is employed to drill the horizontal holes in the concrete 4. The holes will then receive the steel dowel pins.

The drill apparatus 10 includes a main or outer square tubular frame member 12. Disposed and movable within the outer, main tubular frame members 12 is an inner square tubular frame member 40. The two frame members 12 and 40 are secured together by a pin 54.

The square tubular frame member 12 is square tubing which includes four panels or webs, namely a top panel or web 14, a side panel or web 16, a side panel or web 20, and a bottom panel or web 24. A plurality of apertures 18 extends to the side panel or web 16. Another plurality of apertures 22 extends through the panel or web 20. The apertures 18 and 22 are aligned with each other.

The inner tubular frame member 40 is also square tubing of slightly smaller dimensions than the frame member 12. The tubular member 40 includes four panels or webs, namely a top web or panel 42, a side panel or web 44, a side panel or web 48, and a bottom panel or web 52. A plurality of apertures 46 extends through the side panel or web 44, and another plurality of apertures 50 extends through the side panel or web 48. The apertures 46 and 50 are aligned with each other.

Since the inner frame member 40 telescopes into and out of the outer frame member 12, the overall frame may be adjusted to the desired length. The particular apertures 18, 22, and 46, 50 are then appropriately aligned with each other at the desired overall length of the apparatus 10, and the pin 54 is then inserted through the aligned apertures to secure the tubular frame members 12 and 40 together. It will be understood that the sliding fit between the two tubular frame members 12 and 40 is not too snug, but rather is convenient for providing relative movement between the frame members for adjusting the length of the apparatus. Thus, the outer dimensions of the square tubing 40 and the inner dimensions of the square tubing 12 are such that relative motion is easily accomplished. The frame member 40 moves easily inside the frame member 12.

On the exterior of the outer frame member 12 is a pair of tubular guide elements 30 and 32. The tubular guide element 30 is square tubing and is appropriately secured, as by welding, to the side web 16 adjacent to the bottom web 24. Similarly, the guide element 32 is also square tubing, appropriately secured, as by welding, to the side web 20 adjacent to the bottom web 24. This is best shown in FIGS. 2, 3, and 6. It is also shown in FIGS. 1, 4, and 5.

At the front portion of the inner tubular frame member 40 is a front plate 60. The front plate 60 is a rectangular plate that is higher than it is wide. The plate 60 is appropriately secured, as by welding, to the frame member 40.

A pair of generally parallel vertical slots 62 and 64 extend through the slot 60. The slots 62 and 64 extend vertically from above the frame member 40. Beneath the frame member 40, and also secured to the plate 60, is a drill guide pipe or tube 66. The drill guide pipe or tube 66 is disposed about an aperture which extends through the plate 60.

Between the drill guide pipe 66 and the bottom of the frame member 40 is a hole spacer tube or pipe 80. The spacer tube or pipe 80 extends across the plate 60 and thus generally perpendicularly, or transversely, to the vertical orientation of the slots 62 and 64, and to the length of the frame members 12 and 40. The tube or pipe 80 is preferably secured to the plate 60 as by welding.

The tube or pipe 80 includes a set screw or lock bolt 82 which is used to secure a hole spacer rod 84 within the tube or pipe 80. The purpose of the hole spacer rod 84 is simply to gage the distance or spacing between adjacent holes. Thus, when a hole is drilled, the apparatus 10 is moved laterally until the end of the spacer rod 84 is aligned with the hole just drilled. The apparatus 10 is then in position for drilling another hole. In this manner, the spacing between holes is kept substantially the same.

It will be noted that the rod 84 is generally "L" shaped, with the long arm of the "L" extending through and disposed within the tube or pipe 80. The short leg of the "L" extends forwardly of the frame member 40 and of the plate 60 to adjacent the wall of the concrete structure 4.

A front wheel plate 70 is appropriately secured to the plate 60 by a plurality of bolts 76. The bolts 76 extend through the slots 62 and 64 for securing the wheel plate 70 to the front plate 60.

An axle 72 is appropriately secured, as by welding, to the wheel plate 70. In turn, a single wheel 74 is secured to the axle 72. The use of the single wheel 74 at the front of the drill apparatus 10 facilitates the maneuvering of the apparatus 10 for specifically locating a hole to be drilled. The positioning of the apparatus 10, with only a single wheel at the front of the apparatus, is thus simplified.

At the opposite end of the outer tubular frame member 12 from the inner frame member 40 and the wheel 74 is a transversely extending tubular member 100. The tubular member 100 is a rear frame member having preferably the same square dimensions as the frame member 12 for convenience of manufacturing the apparatus. The rear tubular frame member 100 is thus preferably made of the same square tubing as the frame member 12. A rear plate 110 is appropriately secured to the rear frame member 100, as by welding. The plate 110 is generally of a rectangular configuration and it includes two vertically extending slots 112 and 114. The slots 112 and 114 are best shown in FIG. 1. The plate 110 is aligned generally parallel to the front plate 60, and thus is centrally disposed or oriented with respect to the frame members 12 and 40. However, it will be noted that the plates 60 and 110 are not the same size, as is obvious from the drawing Figures.

At the bottom end of the plate 110, and extending between the plate 110 and the concrete structure 6, is a pilot or thrust wheel 120. The pilot or thrust wheel 120 is secured for rotation in a bracket 122. The bracket 122 is in turn secured to a square tubular member 124. The tubular member 124 extends through an appropriate aperture in the lower portion of the plate 110 and through the adjacent portion of the rear transverse tubular frame member 100. The pilot or thrust wheel 120 is secured, through its bracket 122 and the square tubular member 124, to the transverse tubular frame member 100, and thus to the outer tubular frame member 12, by means of a vertically extending pin 136.

The square tubular member 124 includes a plurality of spaced apart aligned apertures which receive the pin 126. The tubular frame member 100 includes only a pair of aligned holes or apertures through which the pin 126 extends. The specific location of the thrust wheel 120 with respect to the plate 110, the tubular frame member 100, and the frame member 12 may be accordingly adjusted by selecting different pairs of the aligned holes or apertures through which the pin 126 extends. Thus, the thrust wheel assembly is moved inwardly or outwardly until the desired holes in the tubular portion 124 are aligned with the holes in the tubular frame member 100. The pin 126 is inserted to lock the thrust wheel assembly in place.

The combination of adjustments for lengths of the tubular frame members 12 and 40 and the combination of adjustments for lengths of the pilot or thrust wheel assembly and the frame member 12 thus provide flexibility in varying the overall length of the apparatus 10 with respect to the width of the trench 2 between the concrete members 4 and 6.

The thrust wheel 120 rotates in the horizontal plane. As the apparatus 10 moves along the concrete structures 4 and 6, and over the trench 2, the wheel 120 maintains a thrust relationship with the concrete structure 6 for the apparatus 10 to oppose any tendency of the apparatus 10 to move away from the concrete structure 4.

Another plate 140 is appropriately secured to, and movable vertically on, the plate 110. The plates 110 and 140 are secured together by a plurality of bolts 78. The plates 140 may be moved vertically upwardly and downwardly on the plate 110 to position the rear portion of the frame members 12 and 40 relative to a pair of wheels 150. The bolts 78 extend through the parallel and vertically oriented apertures 112 and 114 in the plate 110.

A transversely extending angle iron element 142 is secured, as by welding, to the plate 140. The angle iron 142 extends transversely with respect to the plate and with respect to the telescoping tubular frame members 12 and 40, and thus it is generally parallel to the rear transverse tubular frame member 100.

Appropriately secured to the angle iron member 142, as by welding, are a pair of parallel and aligned axle members or elements 144 and 148. A wheel 146 is in turn secured to the axle member 144, and a wheel 150 is secured to the axle member 148. Thus, the rear of the drill apparatus 10 is supported by a pair of wheels 146 and 150, while the front of the apparatus 10 is supported by a single wheel 74.

As discussed above, the precise positioning of the front of the apparatus 10 is facilitated by the use of a single wheel 74 at the front of the apparatus. At the rear of the apparatus, movement of the apparatus and the stability of the apparatus is enhanced by the use of a double set of wheels, or a pair of wheels comprising the wheels 146 and 150. All three wheels 74, 146, 150 may be of the same size.

The vertical height or orientation of the frame members 12 and 40 is easily varied by utilizing the slots in the front plate 60, which is secured to the inner telescoping frame member 40. The plate 60 is moved relative to the plate 70 to adjust the height of the front of the frame members. The height of the rear of the frame members is adjusted or varied by moving the plate 140 relative to the plate 110 by means of the vertically extending slots 112 and 114 in the plate 110.

Extending vertically upwardly from the top of the angle iron member 142 is a tubular element 160 and a tubular element 162. The vertically extending tubular elements 160 and 162 are spaced apart from each other. A transversely extending tubular member 164 extends between the tubular members 160 and 162.

Secured to the top of the vertical tubular member or element 160 is a winch assembly 170. The winch assembly 170 includes a crank 172 which is manually operated by the user of the apparatus. A cable 174 is connected to the winch assembly 170 and extends from the winch assembly 170 downwardly to the transversely extending tubular frame member 100. A pulley 176 is secured to the top of the tubular member 100 beneath the winch assembly 170. The cable 174 extends around the pulley 176 and extends then generally horizontally along the tubular frame element or member 100 to a pulley 178. The pulley 178 is disposed at about the juncture of the outer telescoping frame member 12 and the transversely extending tubular frame member 100.

The pulley 178 rotates in the horizontal plane, while the pulley 176 rotates in the vertical plane. The direction of the cable 174 is thus changed from vertical to horizontal by the pulley 174. The direction of the cable 174 is again changed ninety degrees from one horizontal direction to another horizontal direction by the pulley 178. From the pulley 178, the cable 174 then extends along the top of the tubular frame members 12 and 40 to a third pulley 180. The pulley 180 is disposed at the front of the inner telescoping frame member 40 and adjacent to the plate 60.

The pulley 180 rotates in the horizontal direction, and the direction of the cable is once again changed as it extends about the pulley 180. The diameter of the pulley 180 is slightly greater than the height of the tubular frame member 40. The cable 174 extends to the pulley 180 on the top of the frame member 40, and then extends rearwardly on the bottom or beneath the frame member 40 away from the pulley 180. The pulleys 176, 178, and 180 include appropriate guide members for guiding the cable 174. Such guide members are not shown in the drawing, and are omitted for clarity.

Beneath the outer or main tubular frame member 12, and adjacent to the front pulley 180, the cable 174 is secured to a movable front drill bracket 190. The front bracket 190, in conjunction with a rear bracket 200, holds a pneumatic drill 210. The pneumatic drill 210 is accordingly disposed beneath the tubular frame member 12. The brackets 190 and 200 are movable along the tubular guide elements 30 and 32. The drill 210 is thus secured to the frame member 12 by the brackets 190 and 200, and the brackets 190 and 200 are in turn movable on the frame member 12 through the guide elements 30 and 32.

Movement of the drill 210 towards the concrete structure 4 is accomplished through the cable 174 by the winch assembly 170. A user of the apparatus 10, by rotating the crank 172 of the winch assembly 170, moves the drill 210 towards the concrete structure 4, and thus drills holes into the concrete structure 4.

Extending outwardly from the pneumatic drill 210, and through the guide tube 66 in the plate 60, is a steel rod 212. At the outer or distal end of the rod 212 is a drill bit. As shown in FIGS. 1 and 5, the steel rod 212 extends into a hole which has been drilled within the concrete structure 4. The steel rod 212 within the concrete structure 4 is shown in phantom in FIG. 5.

As best shown in FIG. 2, the front bracket 190 is of a generally "U" shaped configuration, with the arms of the "U" extending ninety degrees inwardly and disposed over the guide elements 30 and 32. Beneath the bottom flange or web of the bracket 190 is a U-bolt 192. The U-bolt 192 is in turn used to secure or clamp the front portion of the pneumatic drill 210 to the bracket 190. This is shown in FIGS. 1, 4, and 5.

Extending generally horizontally across the front of the bracket 190 is a cable connector rod 194. The rod 194 is preferably welded to the bracket 190. The cable 174 is in turn secured to the rod 194. With the cable 174 secured to the rod 194, movement of the cable 174 causes movement of the bracket 190, and also movement of the drill 210, secured to the bracket 190 by the U-bolt 192.

The rear bracket 200, best shown in FIG. 3, is of a slightly different configuration from the bracket 190. This is due to the design or configuration of the drill 210. The bracket 200 is used to secure the back or rear end of the drill 210 to the frame member 12 through the guide elements 30 and 32. The bracket 200 includes two separate portions or halves, with one half or portion disposed on the guide element 30, and the other half or portion disposed on the guide element 32. The two portions are secured together by means of a pair of bolts 202 and 204. The bolts 202 and 204 extend generally horizontally. The drill 210 is also secured to the bracket 200 by the bolts 202 and 204.

A second winch assembly 220 is disposed on the top of the tubular element 162. The winch assembly 220 includes a crank 222. Rotation of the crank 222 causes rotation of the winch assembly 220. The winch assembly 220 also includes a cable 224. Rotation of the winch assembly 220 by the crank 222 results in the reeling in or the reeling out of the cable 224.

The cable 224 extends downwardly from the winch assembly 220 to a pulley 226. The pulley 226 is journaled for rotation in the transversely extending frame member 100. The pulley 226 rotates in the vertical plane, and is used to change the direction of the cable 224 from a vertical direction to a horizontal direction.

Spaced apart from the pulley 226 is a pulley 228. The pulley 228 is disposed generally beneath the transversely extending tubular member 100 at its juncture with the main or outer frame member 12. The pulley 228 is disposed in the horizontal plane, and it is used to change the direction of the cable 224 from beneath the transversely extending frame member 100 to beneath the frame member 12.

The cable 224 extends from the winch 220 to the pulley 226, from the pulley 226 to the pulley 228, and from the pulley 228 to the bracket 200. At the bracket 200, the cable 224 is secured to the bolt 204.

The winch assembly 170 may be referred to as a "drill-in" winch assembly, and the winch assembly 220 may be referred to as a "drill-out" winch assembly. The winch assembly 170 is used to move the drill 210 horizontally beneath the tubular frame member 12 inwardly toward the concrete structure 4. The forward or "in" movement of the drill 210 thus causes the drill bit, secured to the outer or distal end of the steel rod 212, to move inwardly toward and within the concrete structure 4 for the purpose of drilling a hole.

While the crank 172 is being rotated to move the drill 210 inwardly, rotation of the crank 222 of the winch assembly 220 in the opposite direction allows the drill 210 to move inwardly by providing slack in the cable 224. When the hole has been drilled within the concrete structure 4 to its desired depth, the drill-out winch assembly is then used to retract or to withdraw the drill 210 from the concrete structure 4. The movement of the winch assembly 220, through its crank 222, must, of course, be accompanied by a reverse movement of the winch assembly 170 to provide slack in the cable 174.

Since the movement of the drill away from the work, or in its "out" direction is a relatively simple movement, unaccompanied by anything other than the friction of the brackets 190 and 200 on the guide members 30 and 32, and the weight of the drill 210, the winch assembly 220 is a relatively simple, direct drive assembly. Such is well known and understood in the art. However, movement of the drill 210 inwardly, or toward the concrete structure 4, is more difficult due to the resistance of the concrete 4 to the drilling movement of the steel rod 212 and the drill bit on its end. It is accordingly desirable to include a gearing structure and a ratchet assembly as part of the winch 170. Such elements are, of course, well known and understood.

The purpose of the ratchet assembly is to lock the winch assembly 170 on its inward movement to prevent an inadvertent retraction or backward movement of the drill, as when the drill bit meets added resistance, such as a rock, etc., within the concrete structure 4. For retraction purposes, the ratchet assembly is released, as is also well known and understood. Such elements as the gearing and ratchet systems are not illustrated herein, as they are well known and understood. However, it will be noted that the crank 172 is illustrated as being longer than the crank 222, thus providing a longer moment arm for the winch assembly 170 than for the winch assembly 220.

A stop bracket 240 is used to limit the "in" or forward movement of the drill 210. The stop bracket 240 is an adjustable bracket, and its location along the guide elements 30 and 32 may be adjusted, as desired, in accordance with the length or depth of the holes to be drilled in the concrete structure.

Details of the stop bracket 240 are perhaps best shown in FIG. 6, which comprises a view in partial section taken generally along line 6—6 of FIG. 5.

The stop bracket 240 is a generally elongated or wide, "U" shaped element, with the upper portion of the arms of the "U" bent inwardly and disposed on the guide elements 30 and 32. The bottom leg of the bracket 240 is disposed against the bottom web 24 of the frame member 12.

Also secured to the top of the tubular frame member 12 is a handle assembly 250. The handle assembly 250 includes a pair of arms 252 and 254 which are spaced apart from each other and which are secured together by a cross arm member 256. The arms 252 and 254 are secured to the top web 14 of the outer frame member 12 by a pair of brackets 258 and 260, respectively. The arms 252 and 254 are pivotally secured to the brackets 258 and 260, respectively.

The brackets 258 and 260 include apertures or relieved portions through which the cable 174 extends. The cable 174 is disposed on the upper surface, or just above the upper surface, of the top or upper web 14 of the outer frame member 12, and along the corresponding top or upper surface of the top panel or web 42 of the inner frame member 40 between the pulleys 178 and 180.

The handle 250 may be positioned as desired by a user for moving the apparatus 10. When the apparatus 10 is in the desired position, the handle may be pivoted or folded down and thus moved out of the way of the operator of the apparatus.

At the juncture of the vertical tubular element 162 and the horizontal tubular member or cross member 164 is a control valve assembly 216. The control valve 216 controls the flow of compressed air from a supply hose 214 to an air hose 218. The air hose 218 extends from the valve assembly 216 to the drill 210. The operator of the apparatus 10, in controlling the winches 170 and 220, also controls the supply of air through the valve 216 to the drill 210.

In operation, the drill apparatus 10 is moved to a drilling site where it is desired to drill horizontal holes into a concrete structure. Typically, the use environment is as shown in FIGS. 1, 4, and 5, namely where there are a pair of concrete structures separated by a ditch or the like. The drill apparatus 10 is accordingly designed to extend between the concrete structures, with a single wheel on top of one structure and a pair of wheels on top of the other structure. The drill itself, such as the drill 210, is disposed beneath a frame consisting of a pair of tubular members, including the outer frame member 12 and the inner frame member 40. The height of the frame members 12 and 40 is adjustable with respect to the wheels 74 and 146, 150 by means of the plates 60, 70 at the front of the apparatus and the plates 110, 140 at the rear of the apparatus. The single wheel 74 is secured to the plate 70, and the dual wheels 146, 150 are secured to the plate 140. Since the plates 60 and 110, which are secured to the inner tubular frame member 40 and outer tubular frame member 12, respectively, include vertically extending slots, the frame members 12 and 40 are actually moved vertically upwardly and downwardly relative to the wheels.

The width of the various ditches or trenches, such as the trench 2, at different job sites may vary. The frame members 12 and 40 telescope relative to each other and the overall length of the apparatus 10 may thus be adjusted at a work site. The pin 54 is used to secure the tubular frame members 12 and 40 together through oppositely aligned apertures in the respective frame members.

The overall length of the apparatus 10 may also be varied or "fine tuned" by movement of the pilot or thrust wheel 120 through its bracket 122 and its tubing 124. The holes or apertures in the tubing 124 are spaced apart distances smaller than the spacing of the holes 18 and 46 in the frame members 12 and 40, respectively, to allow for greater flexibility in the overall length of the apparatus 10.

The depth of the holes to be drilled is controlled by an adjustable or movable stop bracket 240 secured to the outer tubular frame member 12 along the guide elements 30 and 32.

Use of the hole spacer rod 84 insures that the spacing between adjacent holes drilled by the drill 210 and the apparatus 10 are consistently the same. As indicated, movement of the hole spacer rod 84 may be adjusted into the hole spacer tube or pipe 80. The rod 84 is locked in the tube or pipe 80 by means of the set screw or lock bolt 82.

As is well known, there are many different lengths of drill steel rods 212 available for use. Accordingly, a particular steel rod 212 will be chosen in accordance with the length or depth of the holes being drilled, the length of the frame members 12 and 40, etc.

While the wheels 146, 150 are shown disposed on the concrete structure 6, if no such structure is present, or if the distance between structures is too great for the apparatus, the wheels 146, 150 may be disposed in (on) the trench 2. In such cases, the thrust wheel 120 may not have a fixed structure to bear against.

Figure 7:
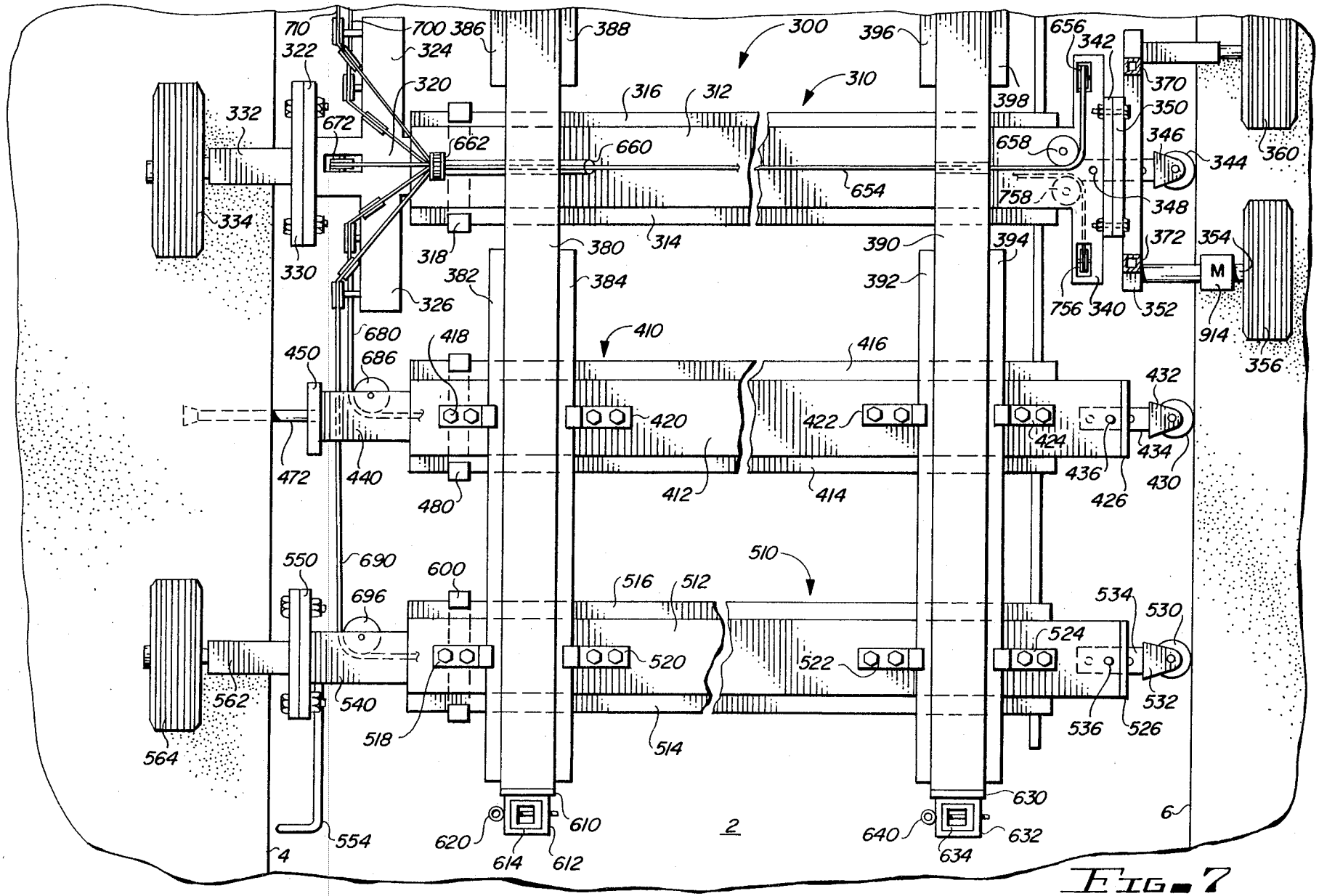
FIG. 7 is a top view of an alternate embodiment of the apparatus of the present invention.
Figure 9:
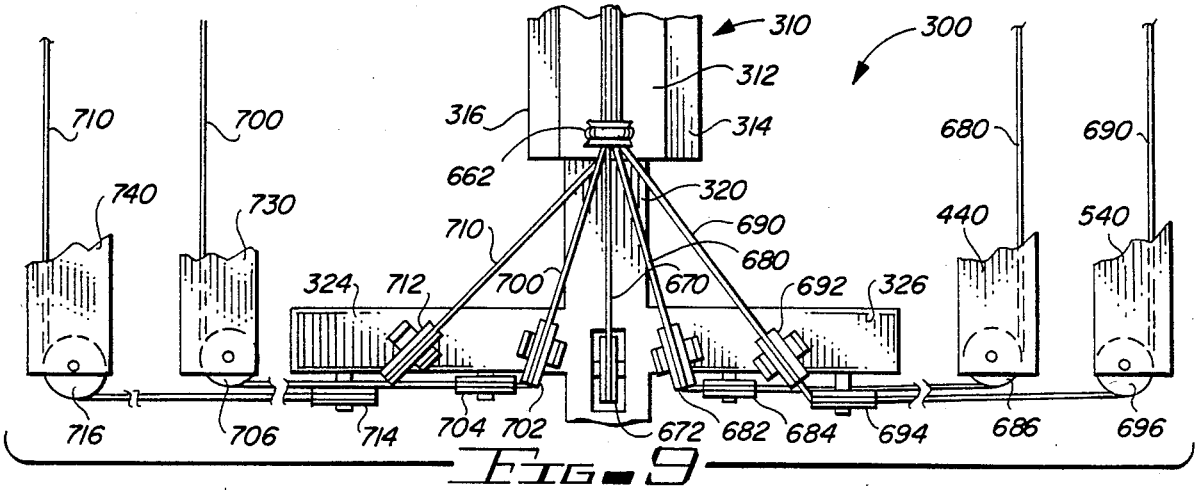
FIG. 9 is a top view of a portion of the apparatus of FIG. 7.
Figure 10:
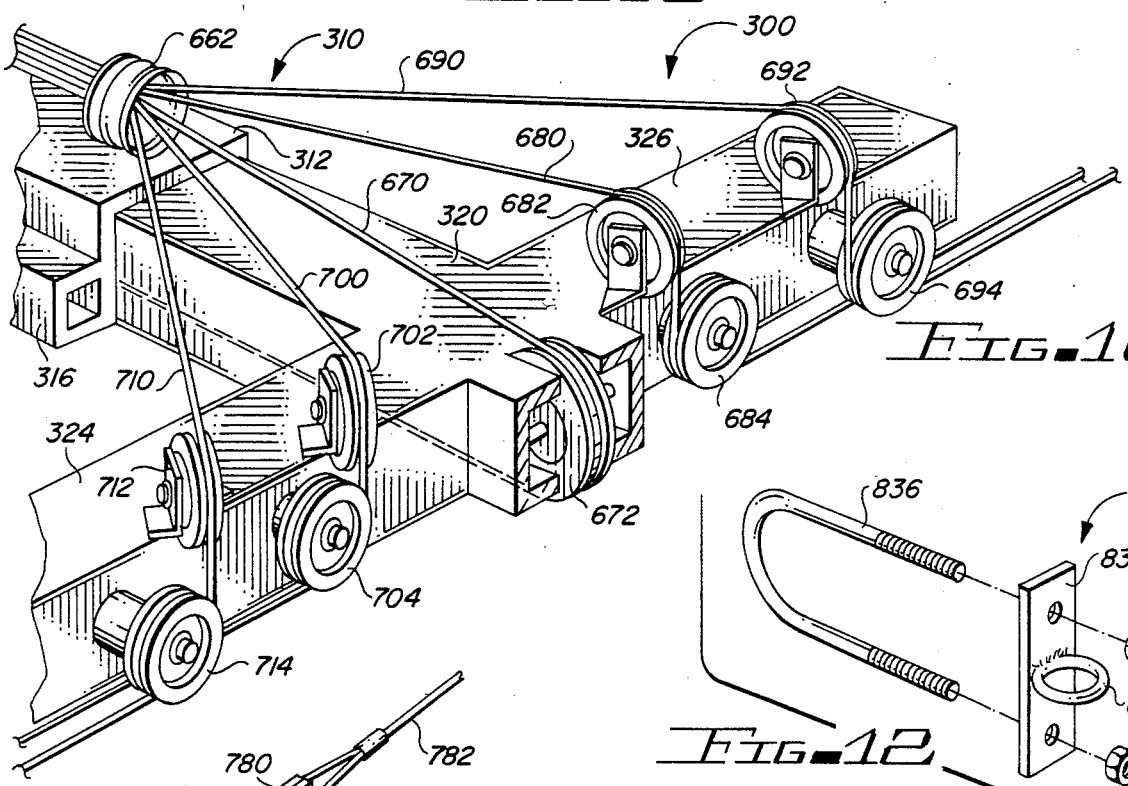
FIG. 10 is a perspective view of the apparatus of FIG. 9.
Figure 12:
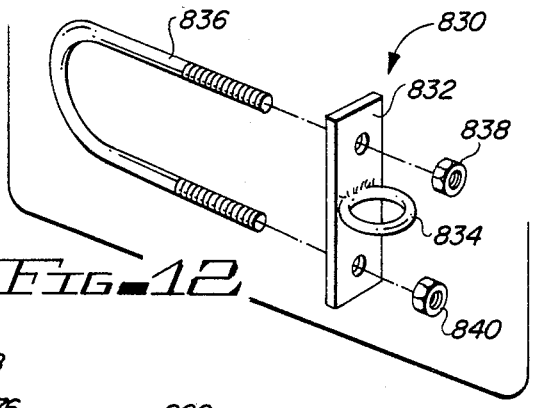
FIG. 12 is an exploded perspective view of an element usable with the apparatus of FIG. 11.
Figure 11:
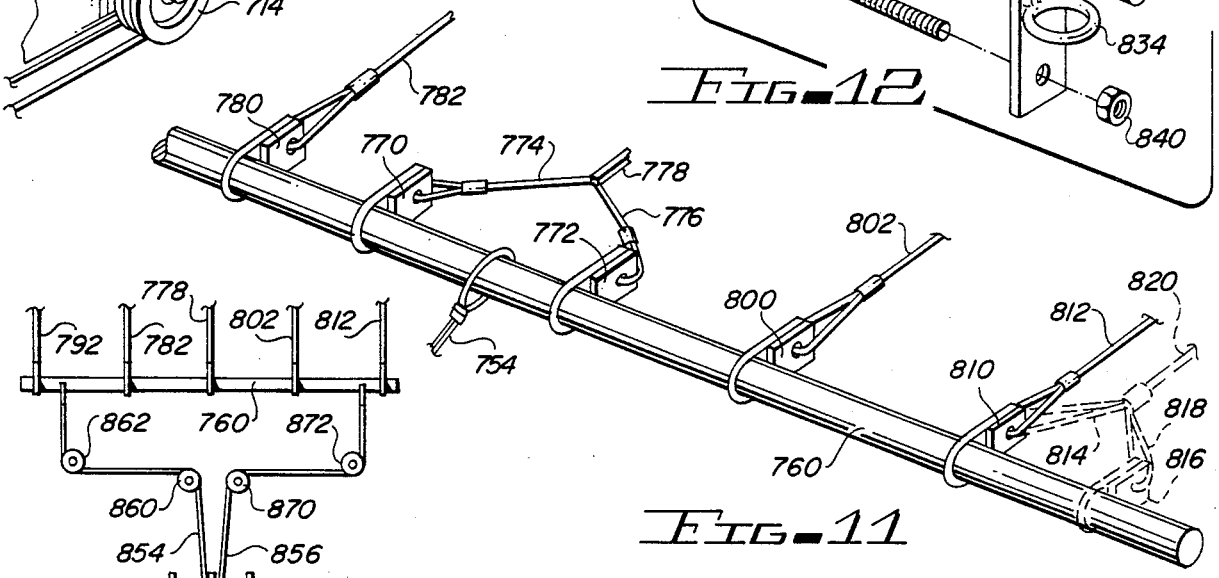
FIG. 11 is a perspective view of another part of the apparatus of FIG. 7.
Figure 13:
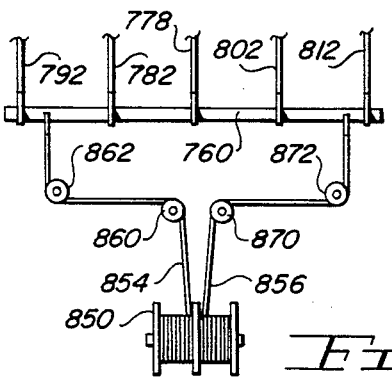
FIG. 13 is a top schematic representation of the apparatus of FIG. 11.

Under certain circumstances, such as when a large number of holes are to be drilled, it may be desirable to use a multi drill apparatus, such as multi drill apparatus 300 shown in FIGS. 7 and 8. FIG. 7 is a top view of a portion of the multi drill apparatus 300, and FIG. 8 is a side view of the multi drill apparatus 300 of FIG. 7. FIG. 9 is a top view of a portion of the multi drill apparatus 300, and FIG. 10 is a perspective view of the apparatus of FIG. 9. FIG. 11 is a perspective view of another portion of the multi drill apparatus 300. FIG. 12 is a perspective view of an alternate embodiment of a portion of the apparatus of FIG. 11. FIG. 13 is a top schematic representation of the apparatus of FIG. 11. For the following discussion, reference will primarily be made to FIGS. 7, 8, 9, 10, 11, 12, and 13.

The multiple drill apparatus 300 as illustrated in FIGS. 7, 8, 9, 10, 11, and 13 includes five separate drills, each of which is secured to a telescoping pair of frame members. In FIG. 7, a central drill unit 310 is illustrated, with two additional drill units, a second drill unit 410 and a third drill unit 510 secured to the central drill unit 310 through a pair of transversely extending tubular frame members 380 and 390. While the two additional drill units, units 4 and 5, are not illustrated in FIG. 6, they are alluded to in FIGS. 9, 10, and 11. The fourth and fifth drill units would be substantially identical to the second drill unit 410 and the third drill unit 510, respectively.

The center drill unit 310 is essentiably the same as the drill unit 10, as discussed above. There are, however, differences which will be discussed in detail.

The center drill unit 310 includes an outer main frame member 312, which is preferably made of square tubing, substantially identical to the outer frame member 12 of the drill apparatus 10. Secured on opposite sides of the frame member 312 is a pair of guide elements 314 and 316. The guide elements 314 and 316 are preferably square tubing, such as the guide elements 30 and 32, discussed above in conjunction with the drill apparatus 10. A stop bracket 318, which is substantially identical to the stop bracket 240, is disposed on the guide elements 314 and 316.

An inner frame member 320 is disposed within the outer frame member 312. The inner frame member 320 is substantially identical to the inner frame member 40 of the apparatus 10. The frame member 320 is accordingly preferably made of square tubing and it moves longitudinally within the frame member 312.

Secured to the front end of the inner frame member 320 is a front plate 322. The front plate 322 includes a pair of vertically extending slots (not shown). A plate 330 is secured to the plate 322 by a plurality of bolts. The plate 330 supports a wheel 334 through an axle 332. The plates 322 and 330 and the axle 332 and wheel 334 are substantially identical to their corresponding elements on the drill apparatus 10.

Extending laterally or transversely from, and secured to, the frame member 320 is a pair of frame members 324 and 326. The frame members 324 and 326 are preferably square tubing of substantially the same cross-sectional area as the frame member 320. The frame members 324 and 326 are appropriately secured, as by welding, to the frame member 320, and are preferably aligned with each other. The purpose of the frame members 324 and 326 is to support a plurality of pulleys which are used in conjunction with cables used to move the drills supported by the drill units. This will be discussed in detail below, primarily in conjunction with FIGS. 9 and 10.

A rear transverse frame member 340, preferably of tubular configuration, and with the same dimensions as the frame member 312, is secured to the rear of the frame member 312, remote from the frame member 320. The purpose of the transverse frame member 340 is substantially the same as for the transverse frame member 100, discussed above in conjunction with the drill apparatus 10. This will be discussed in detail below, primarily in conjunction with FIG. 11.

Appropriately secured, as by welding, to the transverse frame member 340, and aligned with the frame member 312, is a rear plate 324. The rear plate 342 includes a pair of vertically extending slots (not shown). The rear plate 342 is substantially identical to the rear plate 110, discussed above in conjunction with drill apparatus 10.

A thrust wheel assembly, including a thrust wheel 344, a bracket 346, and a tubular member, extends outwardly from the rear plate 342 and the transverse frame member 340. The thrust wheel assembly is secured to the frame member 312 through the transverse frame member 340 and a pin 348. The arrangement of the thrust wheel 344, and its overall assembly, is substantially the same as discussed above in conjunction with the thrust wheel 120 and its assembly for the drill apparatus 10.

A plate 350 is appropriately secured, as by bolts, to the rear plate 342. The plate 350 may be adjusted vertically with respect to the plate 342 by means of the vertical slots in the plate 342.

An angle iron 352 is appropriately secured, as by welding, to the plate 350. Extending outwardly from the angle iron 352 is a pair of axles which support a pair of wheels. An axle 354 and a wheel 356 are shown in FIG. 7. A wheel 360 is also shown in FIG. 7.

Extending upwardly from the angle iron 352 is a pair of tubular members 370 and 372. The vertically extending tubular members 370 and 372 are appropriately secured, as by welding, to the angle iron 352. The tubular members 370 and 372 comprise part of a framework which supports a pair of winch systems or assemblies, including a winch assembly 650 and a winch assembly 750. The winch assemblies 650 and 750 will be discussed below, primarily in conjunction with FIGS. 9, 10, and 11.

The transversely extending frame members 380 and 390 are substantially identical to the frame member 312. They are a pair of tubular frame members appropriately secured, as by welding, to the top of the tubular frame member 312.

Outwardly from the frame member 312, the frame members 380 and 390 each include two pairs of guide elements appropriately secured, as by welding, to the members 380 and 390. The front transverse frame member 380 includes a first pair of guide elements 382 and 384 and a second pair of guide elements 386 and 388. The rear transverse frame member 390 includes a first pair of guide elements 392 and 394 and a second pair of guide elements 396 and 398. The guide elements 382, 384, 386, 388, 392, 394, and 396, 398 are preferably square tubing, welded to their respective frame members, substantially identical to the guide elements 314 and 316 as secured to the frame member 312. The second, third, fourth, and fifth drill units are secured to the central unit 310 by means of the transversely extending frame members 380, 390 and their tubular guide elements. This is best illustrated in FIGS. 7 and 8.

The second drill unit 410 includes an outer tubular frame member 412 and an inner tubular frame member 440. The tubular frame members 412 and 440 are substantially identical to the tubular frame members 312 and 320, respectively. The inner frame member 440 is telescopingly movable within the outer frame member 412.

The outer tubular frame member 412 includes a pair of tubular guide elements 414 and 416 appropriately secured, as by welding, to the side webs or flanges of the frame member 412.

The second drill unit 410 is secured to the transversely extending frame members 380 and 390 by two pairs of clamps, including a pair of clamps 418 and 420, which are used to secure the second drill unit 410 to the front transversely extending frame member 380, and a pair of clamps 422 and 424, which are used to secure the second unit 410 to the rear transversely extending frame member 390.

The clamps 418, 420 and 422, 424 are preferably bolted to the top web of the frame member 412, and they clamp onto the guide members 382, 384 and 392, 394 respectively. By loosening the bolts which hold the clamps to the frame members 380 and 390, the second drill unit 410 may be moved laterally on the transversely extending frame members 380 and 390 to vary the distance of the second drill unit 410 from the center drill unit 310.

At the rear of the frame member 412 is a rear plate 426. A thrust wheel assembly, including a thrust wheel 430, a bracket or yoke 432, and a tubular member 434, is secured to the frame member 412 through the plate 426. The plate 426 accordingly includes an aperture or hole through which the tubular member 434 extends. The thrust wheel assembly is secured to the frame member 412 by means of a pin 436. As with the other thrust wheel assemblies discussed herein, the tubular member 434 includes a plurality of holes or apertures through which the pin 436 may extend to lock the thrust wheel assembly to the frame member 412 after the thrust wheel assembly has been positioned as desired with respect to the frame member 412. As shown in FIG. 7, the thrust wheel 344 and the thrust wheel 430 are both disposed against the concrete structure 6. The thrust wheels, of course, rotate in the horizontal plane, substantially as discussed above for the thrust wheel 120 and the drill apparatus 10. The thrust wheels for all of the drill units, of course, provide longitudinal stability as the drills are operated during their drilling operations, as discussed above.

At the front of the tubular frame member 440 is a front plate 450. The front plate 450 extends downwardly from the frame member 440 and it includes a guide tube through which a drill steel rod 472 extends. The drill to which the drill steel rod 472 is secured is not shown.

Movement of the drill for the drill unit 410, not shown, but disposed beneath the frame member 412, is accomplished by means of appropriate brackets, also not shown, which move on the guide elements 412 and 414. This is substantially the same as with respect to the brackets 190 and 200 for the drill 210, as discussed above in conjunction with the drill apparatus 10.

The forward or "in" movement of the drill is limited by a stop bracket 480. The stop bracket 480 is substantially identical to the stop bracket 240, as discussed above in conjunction with the drill apparatus 10, and as perhaps best shown in FIG. 6. The stop bracket 480 is also, of course, substantially identical to the stop bracket 318 which is secured to the frame member 312 of the center unit 310.

The third drill unit 510 includes an outer tubular frame member 512, which is substantially identical to the frame members 312 and 412 of the first and second drill units 310 and 410, respectively. A pair of tubular guide elements 512 and 516 are appropriately secured, as by welding, to the side webs of the frame member 512.

A pair of clamps 518 and 520 is used to secure the frame member 512 to the transverse frame member 380. The clamps 518 and 520 are secured, as by bolts, to the top web of the frame member 512. The clamp 518 clamps onto the guide element 382, and the clamp 520 clamps onto the guide element 384.

A pair of clamps 522 and 524 is used to secure the frame member 512 to the transverse frame member 390. The clamp 522 is secured, as by bolts, to the top web of the frame member 512, and it is clamped to the guide member 392. The clamp 524 is also secured to the top web of the frame member 512 by a pair of bolts, and is clamped to the guide member 394. By loosening the bolts of the clamps 518, 520 and 522, 524, the third drill unit 510 may be adjusted laterally along the transverse frame members 380 and 390 to vary the distance between the second unit 410 and the third unit 510.

At the rear of the frame member 512 is a rear plate 526. The rear plate 526 includes an aperture through which a tubular member 534 of a thrust wheel assembly extends. The tubular member 534 is secured to a bracket or yoke 532 to which a thrust wheel 530 is journaled for rotation. A pin 536 is used to secure the thrust wheel assembly in place with respect to the frame member 512. The tubular member 534 includes a plurality of spaced apart and aligned apertures to allow for the adjustment or placement of the thrust wheel assembly relative to the frame member 512, and also relative to a structure, such as the concrete structure 6, against which the thrust wheel 530 bears. As with the other thrust wheels discussed herein, the thrust wheel 530 rotates in the horizontal plane. The thrust wheel 530 provides longitudinal stability, as discussed above for the other thrust wheels.

An inner tubular frame member 540 telescopingly engages the frame member 512. The tubular frame member 540 is preferably of a square configuration, designed to extend into and move within the outer tubular frame member 512. The inner frame member 540 is accordingly substantially identical to the inner frame members 440 and 320, discussed above.

The inner and outer frame members of the multiple drill unit are, of course, pinned together, as are the frame members 12 and 40 of the drill apparatus 10. There are a plurality of aligned holes or apertures in the inner and outer frame members to allow for adjusting or varying the length of the apparatus 300 by means of the telescoping frame members, all as discussed above in conjunction with the drill apparatus 10. As shown in FIG. 8, a pin 542 is used to secure together the inner frame member 540 and the outer frame member 512 of the third unit 510.

A front plate 550 is appropriately secured, as by welding, to the front of the tubular frame member 540. The plate 550 includes a pair of vertically extending slots (not shown), substantially identical to the slots in the corresponding plate 322 of the center unit 310. Beneath the inner frame member 540, a spacer rod bracket or tube 552 is secured to the plate 550. The spacer rod bracket or tube extends horizontally, and transversely, with respect to the plate 50. A hole spacer rod 554 extends through the bracket or tube 552. The hole spacer rod is adjustably secured to the bracket or tube 552 for gaging the distance between holes to be drilled.

A drill rod guide 556 is secured to the plate 550 for supporting a steel rod 592 of a drill 590. The guide 556 is disposed beneath the bracket 552 and below the frame member 540. The guide 556 extends through the plate 550. The steel rod 592, of course, extends through and is supported by the guide 556.

A plate 560 is secured to the plate 550, as by bolts. The height or location of the plate 560 is adjustable on the plate 550 by means of the vertical slots in the plate 550. An axle tube or assembly 562 extends from the plate 550 to a single wheel 564. The plate 560 accordingly supports the wheel 564. The wheel 564 is shown disposed on the top of the concrete structure 4. The drill rod 592 extends into the concrete structure 4 beneath the wheel 564.

It will be noted that the center drill unit 310 includes a single front wheel 334 and a pair of rear wheels 356 and 360. The third or outermost drill unit 510 also includes only a single front wheel 564, while the second drill unit 410 does not include any supporting wheels. Moreover, the third drill unit 510 does not include rear support wheels. Rather, the outer or distal ends of the transversely extending frame members 380 and 390 include vertical support legs, as will be discussed below. It will also be noted that all of the drill units are substantially parallel to the first or center drill unit, and accordingly are generally parallel to each other.

For supporting the drill 590, a pair of drill brackets are used. The drill brackets include a front drill bracket 570 and a rear drill bracket 580. The drill brackets 570 and 580 are sub-stantially identical to the drill brackets 190 and 200, discussed above in conjunction with the drill apparatus 10.

The drill bracket 570 includes a U-bolt 572 which extends about the front portion of the drill 590 to secure the drill to the bracket 570. The drill bracket 570 also includes a cable connector rod to which a cable is secured for moving the drill 590 inwardly toward the concrete structure 4. The rear drill bracket 580 includes a bolt to which a cable is secured for retracting or moving the drill rearwardly, away from the concrete structure 4. The drill brackets 570 and 580 are movable on the guide members 512 and 514.

Movement of the drill 590 in the forward position is limited by a stop bracket 600. The stop bracket 600 is secured to the frame member 512 at, and moves on, the guide elements 512 and 514. The stop bracket 600 is substantially identical to the other stop brackets discussed herein, including the stop brackets 480, 318, and 240.

At the outer or distal end of the transversely extending frame member 380 is a plate 610. A tubular socket 612 is welded to the plate 610. Extending through the tubular socket 612 is a square support leg 614. The support leg 614 is secured to the tubular socket 612 by means of a pin 620.

The support leg 614 includes a plurality of spaced apart and aligned apertures, and the tubular socket 612 includes a pair of aligned apertures. The support leg 614 accordingly may be moved vertically upwardly and downwardly with respect to the tubular socket 612. At the desired height or location, the appropriate apertures or holes are aligned, and the pin 620 is inserted to secure the support leg 614 to the socket 612.

At the bottom of the support leg 614 is a plate 616. A movable or casterable wheel 618 is in turn secured to the plate 616.

At the outer or distal end of the transverse frame member 390 is a plate 630. Secured to the plate 630 is a tubular socket 632. Extending through the tubular socket 632 is a square support leg 634. The support leg 634 is movable vertically upwardly and downwardly within the socket 632 and is appropriately secured thereto by a pin 640. At the bottom of the support leg 634 is a casterable wheel 638 secured to a plate 636.

The socket 632 includes a pair of aligned apertures, and the support leg 634 includes a plurality of aligned apertures. The vertical height of the support leg 634 relative to the socket 632 and the transverse frame member 390 is accordingly varied by vertical movement of the support leg 634 in the socket 632. When the desired apertures are aligned, the pin 640 is inserted to lock the support leg 634 to the socket 632 and accordingly to the transverse frame member 390.

The description of the second drill unit 410 and the third drill unit 510 apply also to the fourth and fifth drill units, respectively. That is, the outer or fifth drill unit, not shown, includes a front wheel, like the front wheel 564 of the third drill unit 510. The fourth and fifth drill units each include thrust wheels at their rear ends. The thrust wheels are adjustable, like the other thrust wheels discussed herein. The thrust wheels bear against the concrete structure 6, like the thrust wheels 344, 430, 530, and 120.

The fourth drill unit, midway between the center drill unit 310 and the outermost or fifth drill unit, includes only a thrust wheel at the rear end of the unit, but no support wheel at the front end. The opposite outboard or distal ends of the transverse support members 380 and 390, remote from the outer ends at which the plates 610 and 630 are secured, also include end plates and tubular sockets for supporting the outer ends of the support members and the drill units.

It will be noted that the wheels at the bottom of the support legs are casterable, and thus move relatively easily. On the other hand, if it is not desired that the wheels contact the ground during movement of the multiple drill unit 300, the support legs may be disposed upwardly within their tubular sockets and may be locked in place to provide clearance between the ground or trench and their wheels during movement of the apparatus.

As mentioned above, two winch assemblies are supported on the vertically extending frame members 370 and 372. As shown in FIG. 8, a winch assembly 650 is disposed at the top of the tubular frame member 370, and a winch assembly 750 is disposed on the tubular frame member 372. The winch assembly 650 is substantially identical to the winch assembly 170 of the drill unit 10. It comprises a "drill-in" winch assembly and includes a relatively long handle 652 to provide a relatively long movement arm. The winch assembly 650 preferably includes a gearing unit to aid in the inward movement of the five drills of the multiple drill unit apparatus 300, and a ratchet assembly to prevent the inadvertent retraction or outward movement of the drills.

The winch assembly 750, disposed on the top of the vertically extending frame member 372 retracts or withdraws the drills from the concrete structure in which they are drilling. The winch assembly 750 accordingly includes a handle 752 which is shorter than the handle 652. Provisions for a gearing system and a ratchet assembly are generally not required for the "out" winch 750.

A cable 654 extends downwardly from the winch assembly 650 to a pulley 656, and from the pulley 656 to a pulley 658. The pulley 656 rotates in a vertical plane, and the direction of travel of the cable 654 is changed from vertical to horizontal by the pulley 656. The pulley 658 rotates in the horizontal plane, and the direction of travel of the cable 654 is changed ninety degrees in the horizontal plane by the pulley 658. From the pulley 658, the cable 654 extends through an appropriate opening in the transversely extending frame member 390 and to a connector 650. At the connector 650, the cable 654 is secured to five separate cables, one cable for each drill unit.

The cable 654 and/or the five combined cables extend through an appropriate opening in the transversely extending frame member 380 so as to move in an unimpeded manner on top of the frame member 312. The five cables then extend through an eye 662 disposed adjacent to the outer or distal end of the outer frame member 312. From the eye 662, the five individual cables extend through a pulley system to the respective drill units. This is best shown in FIGS. 9 and 10.

A center cable 670 extends from the cable connector 660 to a pulley 672 which is journaled for rotation in the vertical plane in the inner frame member 320 of the first or center drill unit 31. From the pulley 672, the cable 670 extends beneath the frame members 320 and 312 to a front drill bracket, not shown, which is in turn secured to a drill, also not shown. However, the front drill bracket for the drill unit 310 is substantially identical to the drill brackets 190 of the drill apparatus 10, and the drill 590 and its drill brackets 570 of the third drill unit 510, illustrated in FIG. 8.

A second cable 680 extends from the cable connector 660 to a pair of pulleys 682 and 684 secured to the transversely extending frame member 326. The pulley 682 is disposed on top of the frame member 326 and is journaled for rotation in the vertical plane. The pulley 684 is also journaled for rotation in the vertical plane. However, the two pulleys 682 and 684 are disposed in an angular relationship to each other to allow the cable 680 to extend outwardly from the eye 662, downwardly from the pulley 682, and outwardly from the pulley 684 generally parallel to, but beneath, the transversely extending frame member 326. The cable 680 then extends to a pulley 686 disposed beneath the inner frame member 440 of the second drill unit 410. The cable 680 then extends to a front drill bracket, not shown, but such as discussed above.

A cable 690 extends from the cable connector 660 and through the eye 662 to a pair of pulleys 692 and 694 which are secured to the transverse frame member 326. The pulley 692 is disposed on the top of the frame member 326, and rotates in the vertical plane. The pulley 694 is disposed beneath the pulley 692 and it also rotates in the vertical plane. However, the angle between the pulleys 692 and 694 is such as to allow the cable 690 to extend from the eye 662 at an angle to the pulley 692 and thence downwardly to the pulley 694.

From the pulley 694, the cable 690 extends generally horizontally and beneath the frame member 326 to a pulley 696 which is in turn disposed beneath the inner frame member 540. The pulley 696 rotates in the horizontal plane and accordingly the direction of travel of the cable 690 is changed ninety degrees by the pulley 696. From the pulley 696, the cable 690 extends beneath the frame member 540, and also beneath the frame member 512, to the front drill bracket 570, as discussed above. The drill bracket 570 is secured by the U-bolt 572 to the drill 590.

Two cables 700 and 710 extend from the cable connector 660 and through the eye 662 to pulleys secured to the transverse frame member 324. The cable 700 extends to a pair of pulleys 702 and 704, which are oriented in the opposite direction, but are substantially identically oriented to the pulleys 682 and 684 for the cable 680. The cable 700 thus extends at an angle to the pulley 702 from the eye 662, and thence downwardly to the pulley 704, and thence outwardly, below the transverse frame member 324. The cable 700 then extends to a pulley 706, which is disposed beneath an inner frame member 730 for the fourth drill unit. The cable 700 then extends to an appropriate front drill bracket on the fourth drill unit.

The cable 710 similarly extends to a pair of pulleys 712 ano 714, both secured to the frame member 324. The pulleys 712 and 714 are disposed in an angular orientation on the drill bracket 324 substantially the same as, but as a mirror image of, the pulleys 692 and 694. The cable 710 extends over the pulley 712, thence downwardly around the pulley 714, and outwardly, below the transverse frame member 324, to a pulley 716 secured to the front of an inner frame member 740 for the fifth drill unit. The cable 710 then extends to a frame drill bracket on the fifth drill unit.

It will be understood that movement of the cable 654 by the winch assembly 650 will result in the pulling of all five of the cables 670, 680, 690, 700, and 710, which are secured to the cable 654 by the connector 660. In turn, the movement of the five cables 670 . . . 710, as translated by the various pulleys, will result in the substantially common movement of the drill brackets and the drills secured thereto to move the drills inwardly toward the concrete structure, such as a concrete structure 4 shown in FIGS. 7 and 8.

For retracting or withdrawing the drill assemblies, which comprise the various drills as secured to their drill brackets, the winch assembly 750, and its cable 754, is used. The cable 754 extends downwardly from the winch assembly 750, as shown in FIG. 8. The cable 754 extends downwardly to a pulley 756, which rotates in the vertical plane, and thence to a pulley 758, shown in phantom in FIG. 7, which rotates in the horizontal plane. The direction of travel of the cable 754 is thus changed by the pulleys 756 and 758. The pulley 758 is secured at about the juncture of the transverse frame member 340 and the outer frame member 312. From the pulley 758, the cable 754 extends generally along and beneath the frame member 312 to a rod or bar 760, as shown in FIG. 11.

The rod or bar 760 is disposed beneath all five of the drill units and is movable in guide brackets, such as the bracket 762, shown in FIG. 8. The rod or bar 760 is movable within the guide bracket 762 and in other guide brackets (not shown) secured beneath the main or outer frame member of each drill unit. As shown in FIG. 8, the guide bracket 762 is disposed beneath, and secured to, the frame member 512 of the third drill unit 510.

With the cable 754 extending beneath the center, or first, drill unit 310, the cable 754 is secured to the bar or rod 760 about in the center of the bar or rod. The rear drill brackets of each of the drill assemblies are in turn secured by a cable to the rod or bar 760.

As shown in FIG. 11, a bracket 770 and a bracket 772 are spaced apart along the bar 760 from the connection of the cable 764 to the bar. The brackets 770 and 772 each include a relatively short cable 774 and 776, respectively, which extend to a single cable 778. The cable 778 in turn extends to the rear drill bracket for the drill assembly beneath the first or central drill unit 310. This is an example of using two brackets in a yoke or "Y" type arrangement leading to a single cable.

Outwardly from the bracket 770 is a bracket 780. A cable 782 extends from the bracket 780 to the drill assembly beneath the second drill unit 410.

Spaced apart outwardly from the bracket 772 is a bracket 800. A cable 802 extends from the bracket 800 to a rear drill bracket beneath the fourth drill unit.

Outwardly from the bracket 800 is a bracket 810. A cable 812 extends from the bracket 810 to the rear drill bracket of the fifth drill unit.

Shown in phantom, adjacent to the bracket 810, and spaced apart therefrom, is another bracket 816. A pair of cables 814 and 818, both relatively short, and also shown in phantom, are connected together in a "Y" configuration to another cable 820. The cable 814 is connected to the bracket 810, and the cable 818 is connected to the bracket 816. The bracket 816 and the cables 814, 816, and 820 are shown in phantom as in another example of a "Y" yoke configuration using two brackets for a single drill assembly.

FIG. 12 is a perspective exploded view of a U-bolt type bracket 830 which may be employed for, or in place of, the brackets 770, 772, 780, 800, 810, and 816 shown in FIG. 11. The bracket 830 includes a plate 832 with a ring 834 appropriately secured, as by welding, in the center of the plate. The plate 832 also includes a pair of holes or apertures, equally spaced apart from and on opposite sides of the ring 834. The apertures or holes receive the ends of a U-bolt 836. A pair of nuts 838 and 840 are used to secure the U-bolt 836 to the plate 832.

In use, the U-bolt 836 would extend about the rod or bar 760, and the plate 832 would then be secured to the U-bolt 836 by means of the nuts 838 and 840. A cable would then be secured to the ring 834. The bracket 830 could be positioned as desired on the bar or rod 760 by merely loosening the nuts 838 and 840 and moving the bracket. When the bracket 830 is in its desired new position, the nuts 838 and 840 may be tightened on the U-bolt 836 to secure the plate 832, and a cable secured to the ring 834, to the bar.

FIG. 13 is a top schematic representation of an alternate way of moving the bar 760 to simultaneously withdraw the five drills connected to the bar or rod 760 by using only a single cable connected to each drill and a double winch system.

The bar 760 is shown with five cables connected to five drills. The cable 778 extends from a bracket about the bar 762 to the drill beneath the first or center drill unit. The cable 782 is connected to the bar or rod 760 through a bracket and the cable extends to the drill disposed beneath the second drill unit. A cable 792 is connected to the bar or rod 760 through a bracket and it extends to the rear drill bracket 580 which is secured to the drill 590. The drill 590, as shown in FIG. 8, is disposed beneath the third drill unit 510.

The cable 802 is shown connected to the bar or rod 760 by means of a bracket, and the cable extends to a drill beneath the fourth drill unit. Finally, the cable 812 is shown secured to the bar or rod 760 through a bracket, and the cable then extends to a drill beneath the fifth drill unit. As is understood, the cables 778 . . . 812 each extend to a rear drill bracket which in turn is secured to a drill. This is as discussed above in conjunction with the cable 792 and the drill 590 and its rear drill bracket 580 show in conjunction with the drill 210 and its rear drill 200 for the drill apparatus 10.

Instead of a single cable 754 and a single winch 750 for retracting the bar or rod 760, a double winch 850 is used in the embodiment of FIG. 13. The double winch 850 includes a pair of cables 754 and 756 which are connected to a double reel of the double winch 850. The cable 854 extends to the bar or rod 760 by means of a pair of pulleys 860 and 862. The cable 856 similarly extends to the rod or bar 876 by means of a pair of pulleys 870 and 872. The cables 854 and 856 are disposed adjacent to the outer ends of the rod or bar, oppositely from each other so as to provide a relatively uniform pull on the rod or bar 760 in withdrawing the drills with minimum skewing action of the rod 760. Thus, the two cables 854 and 856, secured to the bar 760 at opposite ends, or spaced apart a substantial distance from each other, would provide a more even pull or draw on the bar 760 than perhaps the single cable 754.

For illustrative purposes, the four pulleys 860, 862, and 870, 872 are all shown as disposed in the horizontal plane. However, it will be understood that the pulleys 860 and 870 rotate in the vertical plane, and are preferably disposed fairly close to each other on the transversely extending frame member 340. The pulleys 862 and 872 will, as shown, generally rotate in the horizontal plane, and may be disposed or secured to either the second and fourth or the third and fifth drill units, respectively, as desired.

The multi-drill apparatus 300 is illustratively discussed herein as including five drill units and thus five horizontally extending drills. If desired, the drill apparatus may include more or fewer drill units, depending on the particular circumstances under which the apparatus is to be used.

The drill apparatus 300 is illustrated as being symmetrical, with the center drill unit 310 as being the primary drill unit and the other four drill units being secondary or slave drill units. The term "primary" simply refers to drill units as including the single front suspension wheel, the dual or paired rear suspension wheels, the winches for moving the drill units, and the control valve for controlling the drills. If the number of drill units is an even number, the primary drill unit should be one of the "inside" units, and not an "outside" unit. That is, it should be disposed between two units, if there are at least three units. Obviously, if there are only two units, there will be no "inside" or "outside" units, but there will still be a primary unit, with the winches, controls, and wheels, and a secondary or slave unit.

Referring again to FIGS. 7 and 8, and primarily to FIG. 8, there is shown a seat 376 on which an operator of the apparatus 300 may sit. The seat 376 is appropriately secured, though not shown in detail, to the framework which includes the angle iron 352 and the vertically extending frame members 370 and 372.

Adjacent to the seat 376, and also secured to the framework, and disposed adjacent to the vertical frame member 372, there is an air supply hose 900. The air supply hose 900 provides compressed air for the operation of the various drills and also for an air motor 914 which is shown secured to the axle 354 and adjacent to the wheel 356. The air supply hose 900 extends to the appropriate connections which include a valve 902 which controls the flow of air to an air supply hose 904, or to a manifold which in turn includes air lines which extend to the five drills that are secured to the drill apparatus 300, including the line or hose 904. As shown in FIG. 8, the hose 904 extends to the drill 590. The control of the valve 902 by an operator accordingly controls the flow of air to operate all of the five drills of the apparatus 300.

A second valve 910 is also supplied with compressed air from the air supply hose 900. The valve 900 controls the flow of air through an air line 912 to the air motor 914. The air motor 914 is appropriately operatively connected to the wheel 356, and thus provides power for moving the apparatus 300 over or in the trench 2 and along the concrete structures 4 and 6.

It will be noted, as referred to above, that the drill apparatus 300 moves along the concrete structures and in or over the trench, and thus the movement is perpendicular to, or transverse to, the longitudinal axes of the drill units. Thus, the wheels 564, 356, and 360 all rotate or move perpendicularly or transversely to the longitudinal axes of the drill units. This is also true for the wheels 74 and 146, 150 for the drill apparatus 10.

The connection between the air motor 914 and the wheel 356 is well known and understood in the art, and is accordingly not illustrated in detail herein. The air motor 914 is preferably a reversible motor, and thus a pair of air lines, of which the line or hose 912 is one, may extend from the valve 910 to the motor for causing the motor to operate or actuate in opposite directions so that the apparatus 300 may move in opposite directions along the structures 4 and 6, as required or as desired.

The provisions of a seat, such as the seat 376, may also be made on the framework which includes the vertically extending frame members 160 and 162 and the cross member 164 and the angle iron 142 for the drill apparatus 10, if desired. Obviously, additional frame members may be required for the provision of seats for the drill apparatus 10 as well as for the drill apparatus 300, in addition to the structural frame members shown or discussed herein. Moreover, an air motor, such as the air motor 914, may also be employed with the drill apparatus 10 and connected to the wheel 150 or to the wheel 146, as desired, for moving the drill apparatus 10.

Each drill unit of the multi-drill apparatus 300 includes a drill frame having axially extending telescoping outer and inner frame members. Each drill frame includes a pilot or thrust wheel movable or rotatable in the horizontal plane and serving primarily for longitudinal stability during drilling operations. The primary drill unit includes a single front wheel and a pair of, or dual, rear wheels. Other drill units, such as the third drill unit 510, which is shown in detail, also include a single front wheel secured to its drill frame. The fifth drill unit, only alluded to herein, and only portions of which are shown in the drawing, would also include a single front wheel.

While cable and winch systems are illustrated in the drawing and are discussed herein, other elements may also be used to move the drills in and out. For example, since the drills are illustrated as being air driven, air motors powered from a common source of compressed air could be used to move the drills in and out. Winch systems are convenient, relatively inexpensive, relatively light in weight, and simple to operate and to maintain. Moreover, the use of the cables allows slack adjustment when and if necessary, even during operation, and variable force applications during operation also. Another advantage of cable and winch systems is the "feel" that an operator has during drilling operations.

The term "horizontal" has been used in describing the drilling operation of the various drills secured to the drill frames. The adjustable heights of the drill frames by means of the front and rear end plates and their vertically extending slots has also been discussed. The vertical slots in the end plates also allow or provide for adjusting the drill frames at angular orientations other than horizontal. Drilling may thus also be accomplished at "up" or "down" angles from the horizontal.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Horizontal drilling apparatus comprising, in combination:

frame means for supporting a drill, including a first frame member, a second frame member movable relative to the first frame member to vary the length of the frame means;

a single wheel secured to the frame means and movable relative to the frame means vertically upwardly and downwardly;

a pair of wheels secured to the frame means remote from the single wheel and movable relative to the frame means vertically upwardly and downwardly;

drill means, including a drill disposed beneath the frame means, movable on the frame means for drilling beneath the single wheel;

thrust means secured to the frmae means adjacent to the pair of wheels for providing longitudinal stability while the drill means is drilling, including a bracket, and a wheel secured to the bracket and rotatable in the horizontal plane; and winch means secured to the frame means, including first winch means connected to the drill means for moving the drill for drilling beneath the single wheel, and second winch means connected to the drill means for withdrawing the drill from drilling beneath the single wheel.

2. The apparatus of claim 1 in which the first winch means includes a first winch for moving the drill means in a first direction and the second winch means includes a second winch for moving the drill means in a second direction.

3. The apparatus of claim 2 in which the first frame member of the frame means further includes guide means and the drill means is secured to and movable on the guide means.

4. The apparatus of claim 1 in which the frame means includes:

primary drill frame means, including the first and second frame members, transversely extending frame means secured to the primary drill frame means, and secondary drill means movably secured to the transversely extending frame means and disposed substantially parallel to the primary drill frame means; and the thrust means includes first thrust means secured to the primary drill frame means, and second thrust means seucred to the secondary drill frame means and the first and second thrust means each include a bracket secured to the respective frame means and a wheel secured to the bracket and rotatable in the horizontal plane.

5. The apparatus of claim 4 in which the single wheel and the pair of wheels are secured to the primary drill frame means.

6. The apparatus of claim 5 in which the drill means includes a plurality of drills, with a drill movably disposed beneath each drill frame.

7. The apparatus of claim 6 in which the drill frames of the frame means includes telescoping frame members for varying the length of the drill frames.

8. The apparatus of claim 7 in which the secondary drill frame means includes a plurality of drill frames movably secured to the transversely extending frame means.

9. The apparatus of claim 8 in which the plurality of drill frames of the secondary drill frame means includes at least two drill frames, and the primary drill frame means is disposed between the two drill frames.

10. The apparatus of claim 4 in which the transversely extending frame means includes support leg means for supporting the secondary drill frame means remote from the primary drill frame means.

11. The apparatus of claim 10 in which the transversely extending frame means includes a first transversely extending frame member and a second transversely extending frame member spaced apart from and substantially parallel to the first transversely extending frame member.

12. The apparatus of claim 11 in which the transversely extending frame means includes outer ends remote from the primary drill frame means, and the support leg means includes support legs movably secured to the outer ends.

13. The apparatus of claim 1 in which the frame means includes a first end plate and a second end plate, and the single wheel is adjustably secured to the first end plate, and the pair of wheels is adjustably secured to the second end plate.

14. The apparatus of claim 13 in which the single wheels and the pair of wheels are vertically adjustable relative to the frame means for providing an angular orientation of the frame means other than horizontal for drilling.

15. The apparatus of claim 1 in which the bracket of the thrust means is adjustable relative to the frame means to provide flexibility in varying the overall length of the frame means.

* * * * *